US005183247A

United States Patent [19]

Blumer

[11] Patent Number: 5,183,247

[45] Date of Patent: Feb. 2, 1993

[54] METHOD OF, AND APPARATUS FOR, DETECTING THE POSITION OF A MARKING OR SEPARATING ELEMENT IN A STACK OF SUBSTANTIALLY FLAT PRODUCTS

[76] Inventor: Hans Blumer, Boppelserstrasse, CH-8112 Otelfingen, Switzerland

[21] Appl. No.: 779,375

[22] Filed: Oct. 18, 1991

[30] Foreign Application Priority Data

Oct. 25, 1990 [CH] Switzerland ..... 3414/90

[51] Int. Cl.[5] ..... B65H 33/10; B65H 33/06

[52] U.S. Cl. ..... 270/95; 270/59

[58] Field of Search ..... 270/52, 52.5, 58, 59, 270/95; 414/798.9, 789.5

[56] References Cited

FOREIGN PATENT DOCUMENTS

| | | | |
|---|---|---|---|
| 384255 | 8/1990 | European Pat. Off. | 270/95 |
| 1212564 | 3/1966 | Fed. Rep. of Germany | 270/59 |
| 140454 | 11/1980 | Japan | 270/95 |
| 66031 | 3/1990 | Japan | 414/798.9 |
| 657338 A5 | 8/1986 | Switzerland . | |

*Primary Examiner*—Edward K. Look
*Attorney, Agent, or Firm*—Oliff & Berridge

[57] ABSTRACT

For detecting and pushing up marking or separating elements in a stack of labels, there are provided a detector arrangement and an ejector element, both of which are mounted at a support or carriage connected to a revolvingly drivable traction element. By setting a driving motor in operation, the support or carriage is moved along the underside of the stack. As soon as the detector arrangement reaches a position in which it is aligned with a marking element, the presence of the marking element is detected by means of the thereby resulting brightness difference. The ejector element is then brought into alignment with the respective marking element and the latter is pushed up by means of the ejector element, so that the marking element protrudes somewhat from the top of the stack. Subsequently, the label package located directly in front or downstream of this marking element is separated from the remaining part of the stack by means of a part-off blade which is driven into the stack, directly behind or upstream of the pushed-up marking or separating element.

18 Claims, 4 Drawing Sheets

METHOD OF, AND APPARATUS FOR, DETECTING THE POSITION OF A MARKING OR SEPARATING ELEMENT IN A STACK OF SUBSTANTIALLY FLAT PRODUCTS

BACKGROUND OF THE INVENTION

The present invention broadly relates to the detection of marking elements in a stack of substantially flat products and, more specifically, pertains to a new and improved method of, and apparatus for, detecting the position of a marking or separating element in a stack of substantially flat products, particularly labels.

Generally speaking, in the practice of the invention for detecting or locating a marking or separating element in a stack of labels, there is provided a detector or sensor arrangement, preferably a photodetector arrangement.

A machine or apparatus for fabricating labels and the like is known, for example, from Swiss Patent No. 657,338, published Aug. 29, 1986. In the machine disclosed therein, a stack of labels and transparent marking foils arranged therebetween are moved stepwise past a fixed or stationary light barrier. Whenever a transparent marking foil travels past the light barrier, the latter triggers the application of an ejector element which pushes to a certain extent the transparent marking foil out of the stack of labels. By virtue of the protruding marking foil, there is activated a parting or detaching element which dips into the stack of labels along the front or downstream side of the respective transparent marking foil, the parting or detaching element thereby parting the stack portion located in front of it.

The problem existing with this label fabricating machine or apparatus known to the art resides in the fact that the light barrier as well as the ejector element are fixedly arranged, while the stack of labels with the marking foils therebetween travels past at a feed speed determined by the cutting stroke of the stamping device. It is thereby readily conceivable that operational reliability decreases when the feed speed of the stack increases. On the other hand, limited feed speed results in a further drawback in that it is difficult to shorten the production time per label package. The output is therefore undesirably low.

SUMMARY OF THE INVENTION

Therefore, with the foregoing in mind, it is a primary object of the present invention to provide a new and improved method of, and apparatus for, detecting the position of a marking or separating element in a stack of substantially flat products, especially labels and the like, and which do not suffer from the aforementioned limitations and drawbacks of the prior art.

Another and more specific object of the present invention aims at providing a new and improved method of, and apparatus for, detecting marking or separating elements in a stack or stacking of substantially flat products, by means of which operational reliability is substantially improved. Additionally, the new and improved method represents a time saving process in that the production time per label package is shortened. Accordingly, the output is increased.

Now in order to implement these and still further objects of the invention, which will become more apparent as the description proceeds, the method of detecting the position or location of a marking or separating element in a stack of substantially flat products, particularly in a stack of labels, is manifested, among other things, by the steps of moving the detector arrangement along the stack from a starting or initial position and, during such motion, detecting the presence of a marking or separating element in the stack.

In accordance with the inventive method, the detector arrangement is then moved into another starting or initial position when the distance covered from the original starting or initial position up to detecting a marking or separating element is shorter than a predetermined distance or range.

It is advantageous to automatically adapt the sensitivity of the detector arrangement for the purpose of providing a sufficiently large brightness difference between the substantially flat products and the marking or separating elements. Such adaptive control of the detector sensitivity is preferably based upon the detection of product brightness during the aforesaid motion or travel of the detector arrangement along the stack.

The marking or separating element detected by the detector arrangement is displaced or shifted by means of an ejector element in a direction substantially transverse to the lengthwise direction of the stack, so that the respective marking or separating element projects over the stack. The ejector element is thereby preferably co-moved with the detector arrangement.

The detection of the marking or separating elements in the stack is advantageously employed for the purpose of detaching or parting individual product packages from the remaining part or portion of the stack, such product packages being determined by respective marking or separating elements.

According to a variant of the inventive method of detecting the location or position of a marking or separating element in a stack of substantially flat products, especially labels and the like, a detector arrangement, preferably a photodetector arrangement, is moved relative to the stack and along the latter and, during this relative motion, detects the presence of a marking or separating element in the stack, whereby the sensitivity of the detector arrangement is automatically adapted to produce a sufficiently large brightness difference between the substantially flat products and the marking or separating elements, whereby sensitivity adaptation is preferably based upon the detection of product brightness during the aforesaid relative motion of the detector arrangement along the stack.

In this variant of the inventive method, it is advantageous to stationarily arrange the detector arrangement.

As alluded to above, the invention is not only concerned with the aforementioned method aspects, but relates also to a new and improved apparatus for detecting the position of a marking or separating element in a stack of substantially flat products, especially labels.

Generally speaking, the apparatus constructed according to the invention and provided for performing the inventive method is of the type comprising a detector or sensor arrangement, preferably a photodetector arrangement.

In order to implement the aforementioned objects of the present invention, which will become more readily apparent as the description proceeds, the apparatus of the present development is manifested, among other things, by the features that there are provided means for moving the detector arrangement along the stack from a starting or initial position, so that, during such motion, the detector arrangement detects the presence of a marking or separating element in the stack.

The moving means advantageously comprise a traction element which is drivable in directions opposite to each other, the detector arrangement being mounted at the traction element.

The apparatus constructed according to the invention further comprises an ejector element which is co-movable with the detector arrangement and preferably mounted at the aforesaid traction element. The ejector element serves to shift or displace the marking or separating element detected by means of the detector arrangement in a direction substantially transverse to the lengthwise direction of the stack, so that the pushed-out marking or separating element projects above the stack.

Furthermore, a detaching or parting arrangement is provided for detaching a stack portion determined by the aforesaid marking or separating element projecting over the stack. The detaching or parting arrangement can be activated by the protruding marking or separating element.

Means are provided for stepwise advance or feed of the stack and a particular advantage is realized when means are provided for automatically adapting the sensitivity of the detector arrangement, whereby such automatically adapting means are preferably structured to adapt detector sensitivity in accordance with brightness detection of the substantially flat products during the motion or travel of the detector arrangement along the stack.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters or numerals to denote the same or analogous components and wherein.

DETAILED DESCRIPTION OF THE PREFERRED EMBODIMENTS

Describing now the drawings, it is to be understood that to simplify the showing thereof, only enough of the construction of the apparatus for carrying out the inventive method and provided for detecting the position of a marking or separating element in a stack of substantially flat products has been illustrated therein as is needed to enable one skilled in the art to readily understand the underlying principles and concepts of the present invention.

Figure 1:
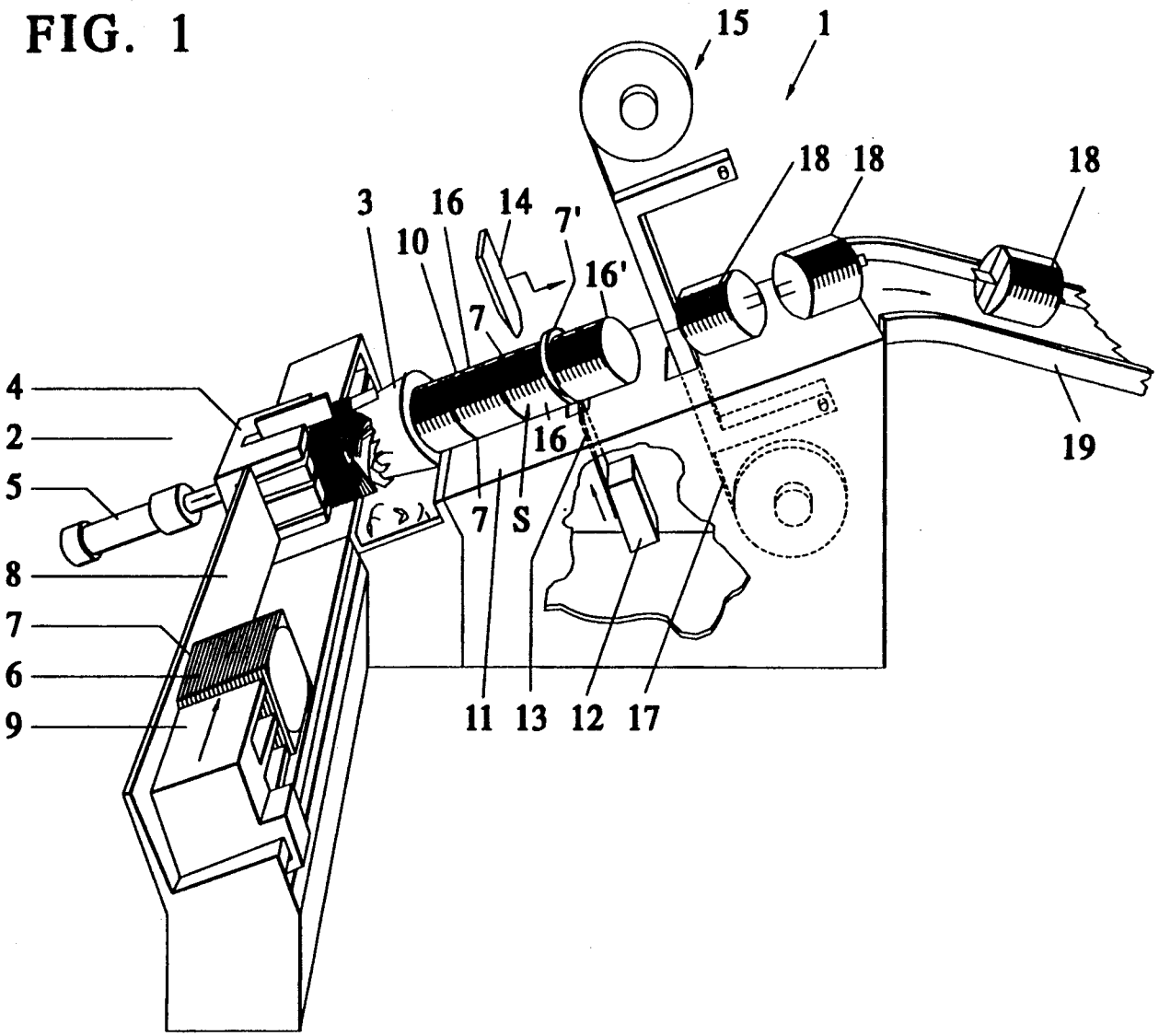
FIG. 1 schematically shows in a perspective illustration an installation for fabricating packages of labels.

Turning attention now specifically to FIG. 1 of the drawings, an apparatus or installation 1 for fabricating packages of labels and illustrated therein by way of example and not limitation will be seen to comprise a stamping unit 2 which operates in known manner in a punching and cutting process. The stamping unit 2 comprises a fixed or stationary blade 3 as well as a ram or slide or plunger 4 which is moved towards the fixed blade 3 and retracted therefrom by means of a pneumatic or hydraulic drive 5. Packs or packages 6 of raw or untrimmed labels are pushed through the fixed blade 3 by means of the ram or slide 4. These packs or packages 6 of raw labels, each of which comprises a marking or separating element 7 as the lowest or bottom layer, for instance a cardboard, are deposited on a feed or conveyance 8 and brought by means of a feeding or feed element 9 into the stamping space of the stamping unit 2, when the ram or slide 4 is in its retracted position.

The stamped labels designated by reference numeral 10 are advanced or brought forward as a lying stack or stacking S along an inclined supporting table 11. In this lying stack or stacking S, the label packages designated by reference numeral 16 border on each other and are appropriately separated from one another by respective marking or separating elements 7.

A detector arrangement 12 arranged below the inclined supporting table 11 as well as an ejector or pusher element 13 serve to subdivide the stack or stacking S in that the individual label packages 16 are detached one after the other from the stack or stacking S. The detector arrangement 12, which is only schematically illustrated in FIG. 1 and will be described in detail in conjunction with FIGS. 2 to 5, detects the presence of a marking element 7 and triggers the actuation of the ejector or pusher element 13 which pushes slightly upwards the just detected marking element designated by reference numeral 7', so that this detected and now ejected marking element 7' projects over the stack or stacking S.

In the course of further shifting of the stack or stacking S along the inclined supporting table 11, a part-off or parting blade 14 is driven into the stack or stacking S directly behind or upstream of the ejected marking element 7', as viewed in the moving direction of the stack S. The part-off or parting blade 14 thereby moves along the ejected marking element 7' into the stack S, advances the label package now designated by reference numeral 16' and lying directly in front or downstream of the ejected marking element 7', and thereby lifts off from the stack or stacking S. This detached label package 16' is then conducted through a banding station 15, in which a band 17 is applied around the detached label package 16'. The ready-banded label packages or bundles designated by reference numeral 18 are guided to the next work or processing station via a discharge structure 19, for instance a chute or a conveyor belt.

The construction of the detector arrangement 12 and of the ejector element 13 as well as the process of detecting and ejecting the marking elements 7 are now hereinafter described in greater detail in conjunction with FIGS. 2 to 6. In FIGS. 2 through 5, there is shown only a part of the apparatus or installation 1 according to FIG. 1, namely the part located between the fixed blade 3 and the banding station 15.

The detector arrangement 12 and the ejector or pusher element 13 are mounted at a common support or carriage 20. This support or carriage 20 is connected to a revolving traction element 21, which is preferably structured as a belt or band guided around two deflection rolls or rollers 22 and 23. The deflection roll or roller 22 is driven by a suitable motor 24, preferably a stepper or stepping motor. The traction element 21 is driven by this motor 24 in the direction of arrow A. As a result, the support or carriage 20 together with the detector arrangement 12 and the ejector element 13 is moved in the direction of arrow B along the underside of the stack or stacking S. As viewed in this direction of travel B, the detector arrangement 12 is arranged downstream of the ejector element 13 and in a predetermined invariable spaced relationship to the latter. At the support or carriage 20, there is further arranged a preferably hydraulic or pneumatic actuating device for the ejector or pusher element 13. However, this actuating device has not been particularly illustrated in FIGS. 2 to 5 in order to simplify the illustration. By means of the actuating device, the ejector element 13 is moved upwards in the direction of arrow E and then again retracted.

The detector arrangement 12 is of a conventional design or structure comprising a light or luminous source and a photodetector. The light emitted from the light or luminous source is reflected at the underside of the stack or stacking S and received by the photodetector. The detector arrangement 12 is responsive to contrasts caused by the difference between the brightness of the labels and the brightness of the marking element 7. In this manner, the detector arrangement 12 detects or locates the presence of a marking element 7 during travel along the underside of the stack S. Subsequent to detection of the marking element 7, the support or carriage 20 is further moved by a distance corresponding to the spacing between the detector arrangement 12 and the ejector element 13, so that the ejector element 13 comes to a stop precisely beneath the detected marking element 7.

Figure 2:
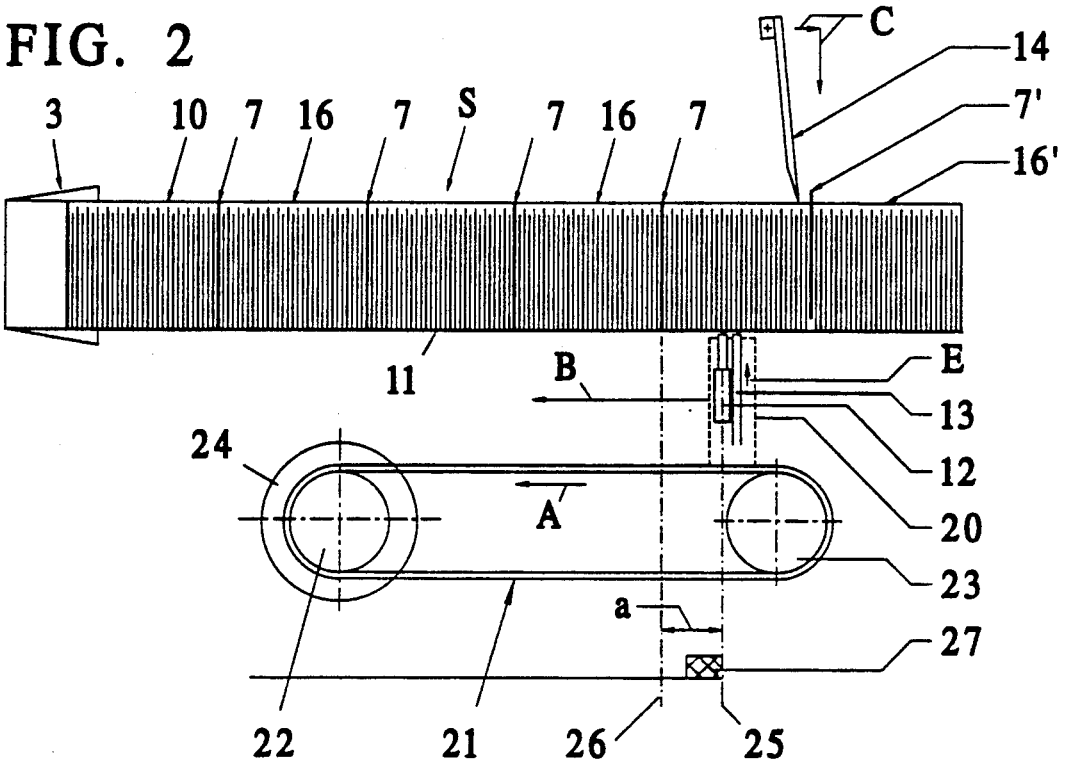
FIG. 2 schematically shows a first operating cycle while forming the packages of labels.

In the operating cycle depicted in FIG. 2, the support or carriage 20 including the detector arrangement 12 and the ejector or pusher element 13 is located in its normal starting or initial position 25. During the return stroke of the ram or slide 4, during which the feed of the stack S in the direction towards the banding station 15 in interrupted, the motor 24 is started and the support or carriage 20 is thereby moved in the direction of the arrow B. When the detector arrangement 12 reaches a position in alignment with a marking element 7 and indicated by a dot-dash line 26, the detector arrangement 12 responds to the presence of this marking element 7, with the result that the support or carriage 20, as previously mentioned, is further advanced by a distance corresponding to the spacing between the detector arrangement 12 and the ejector element 13, and then stopped. The ejector element 13 now in alignment with the detected marking element 7 is actuated, i.e. shifted upwards. As a result, the marking element 7 is pushed upwards, so that it projects beyond the upper side of the stack or stacking S. Subsequent to the return of the ejector element 13, the support or carriage 20 is moved back to its normal starting or initial position 25.

Upon advance travel of the stack or stacking S when the latter is moved or pushed by each working or cutting stroke of the ram or slide 4, the ejected marking element 7' travels past the part-off or parting blade 14 such that the latter is activated by a suitable but here not particularly illustrated drive and moved in the direction of arrow C. The part-off or parting blade 14 is driven directly upstream of the ejected marking element 7' and along the latter into the stack or stacking S, detaches the label package 16' located downstream of the ejected marking element 7' from the stack part or portion located upstream of the latter, and moves this label package 16' together with the associated marking element 7' to the banding station 15.

Figure 3:
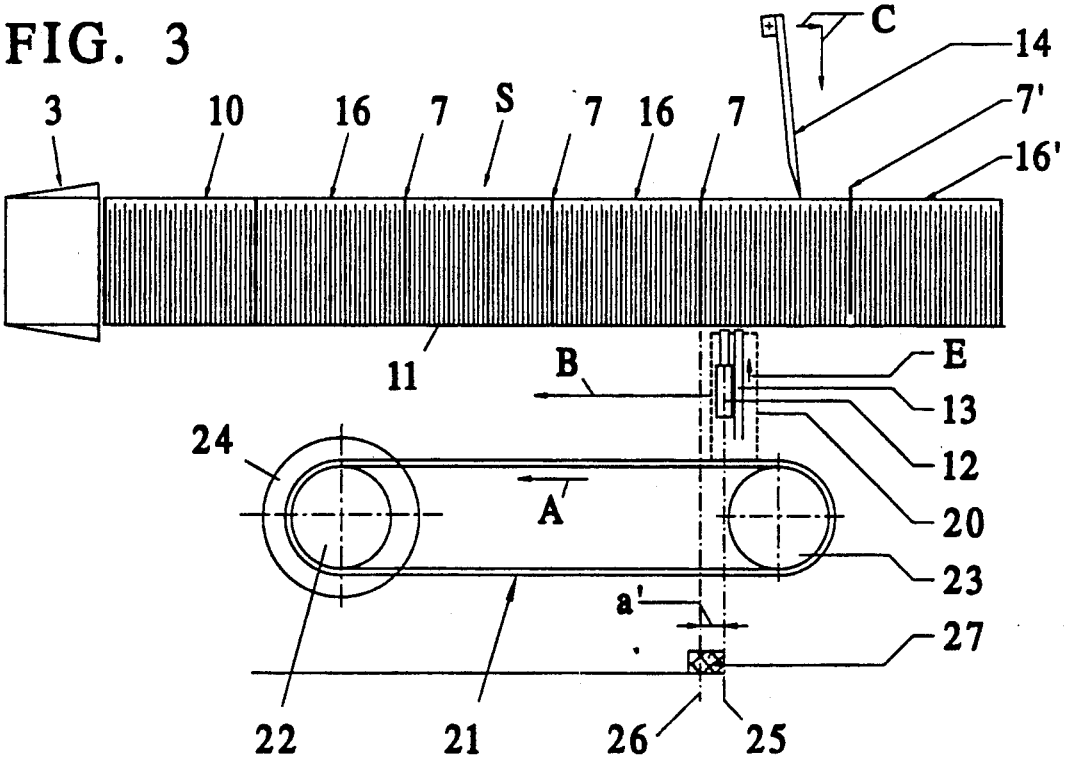
FIG. 3 schematically shows a second operating cycle while forming the packages of labels.
Figure 4:
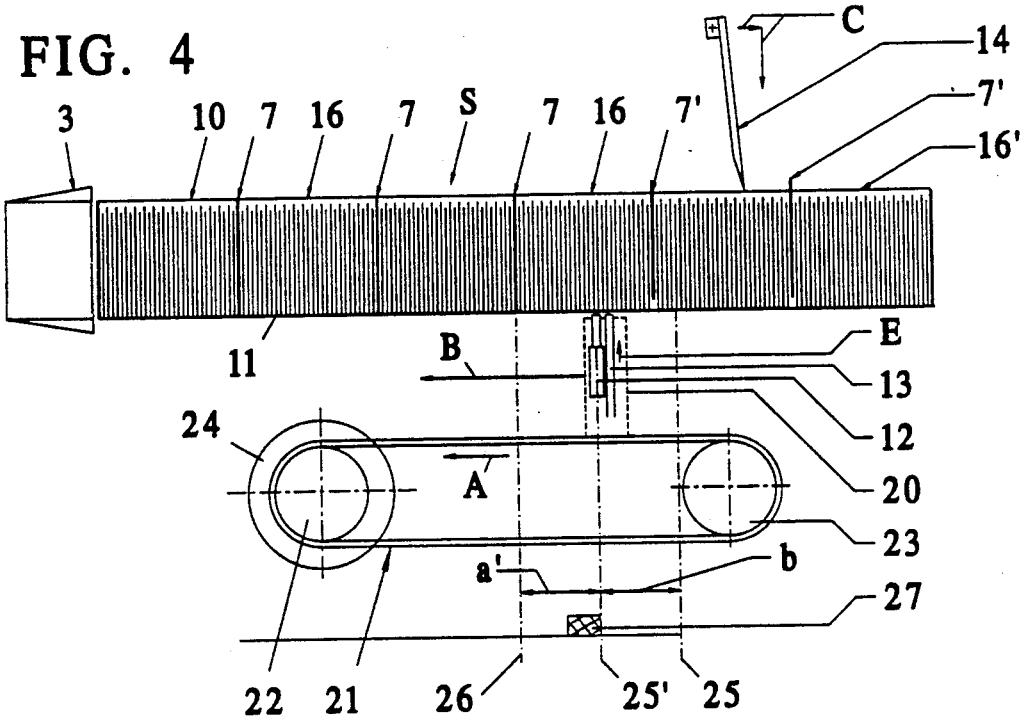
FIG. 4 schematically shows a third operating cycle while forming the packages of labels.

In the aforedescribed operating cycle shown in FIG. 2, the support or carriage 20, i.e. the detector arrangement 12, had to move to a response position 26 thereof and thereby cover a distance a which is longer than a critical distance depicted by a range or region 27. Because of package length variations and as a result of shifting within the individual label packages 16, it can occur that the distance to be covered by the detector arrangement 12 up to detection of a marking element 7 is shorter than the aforesaid critical range 27. Such a situation is illustrated in FIG. 3, from which it is evident that a distance a' covered by the detector arrangement 12 is shorter than the critical range 27. Of course, the detector arrangement 12 is still in a position to detect or locate the presence of the next marking element 7 and trigger thereby the ejection of the latter as described hereinbefore in conjunction with FIG. 2. However, in this position, there is the risk that, in case of further displacement or shifting within the stack or stacking S, one of the following marking elements 7 cannot be detected anymore. In order to preclude such risk, there is effected at this stage a displacement of the support or carriage 20 to another starting position, as will be described in conjunction with FIG. 4.

As soon as the support or carriage 20 only has to cover the distance a' shorter than the critical range 27, as depicted in FIG. 3, there is accomplished, subsequent to pushing up the thereby detected marking element 7, a displacement of the support or carriage 20 in the direction of the arrow B to a new starting or initial position 25'. The length of this displacement has been designated by reference character b in FIG. 4. This distance b corresponds, for example, to half the length of a label package 16. The operation of detecting and ejecting the next marking or separating element 7 is then accomplished from the new starting or initial position 25', the operating cycle being effected in the manner described in conjunction with FIG. 2.

In the course of further processing of the packages 16 arriving from the fixed blade 3, the travel distance a' of the detector arrangement 12 can again progressively diminish as a result of shifting and displacements within the stack or stacking S. Therefore, the distance a' is some time or other shorter than the aforementioned critical range 27, as depicted in the operating cycle according to FIG. 5.

Figure 5:
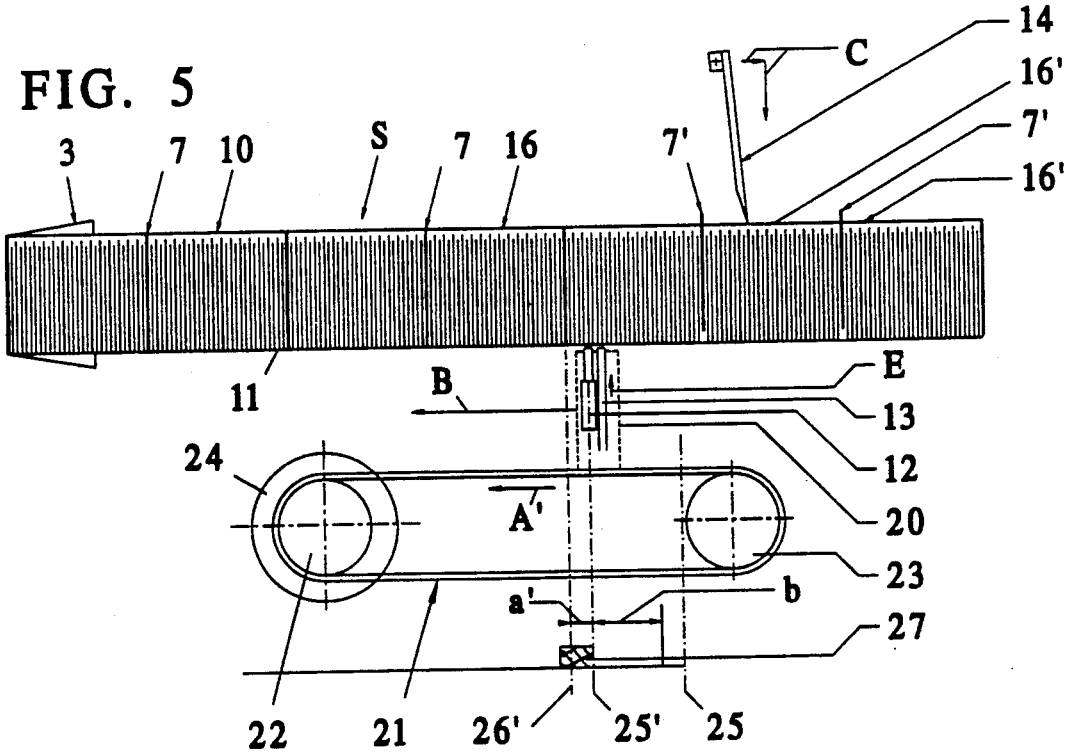
FIG. 5 schematically shows a fourth operating cycle while forming the packages of labels.

In accordance with the showing of FIG. 5, the support or carriage 20, i.e. the detector arrangement 12, must cover the distance a' until it detects or locates a marking or separating element 7, this travel or search distance a' now being shorter than the critical range 27. In this case, the detected marking element 7 is no doubt appropriately pushed up as described in conjunction with FIG. 3, but the support or carriage 20 is subsequently moved from the response or active position conveniently designated by reference numeral 26' back to the original starting or initial position 25.

Figure 6:
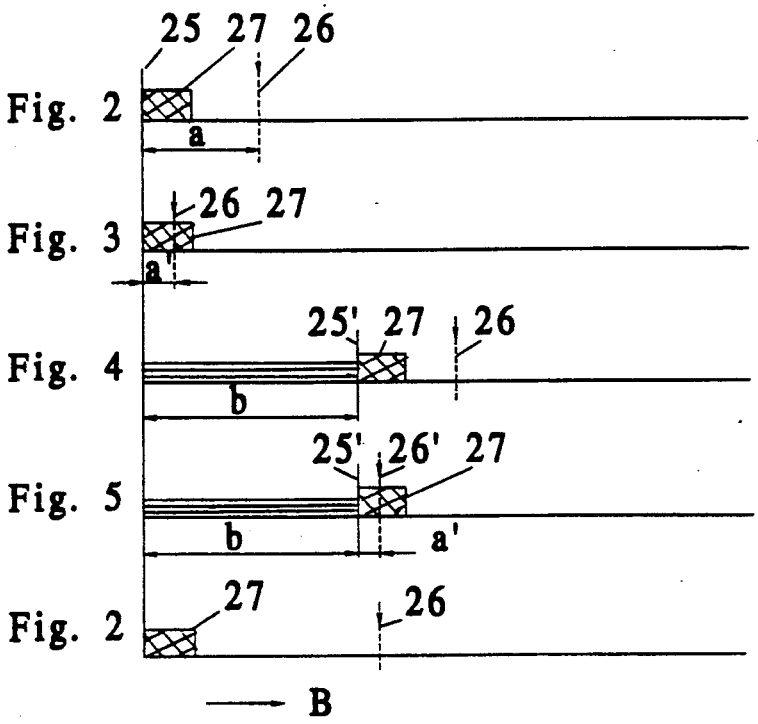
FIG. 6 schematically shows in a summarized illustration the four different operating cycles according to FIGS. 2 through 5.

The aforedescribed operating or motion sequence of the support or carriage 20 and thus of the detector arrangement 12 and of the ejector element 13 is schematically illustrated in FIG. 6. The displacement distance b between the normal starting or initial position 25 and the other or alternative starting or initial position 25' is adjustable and can be appropriately adapted to the length of the individual label packages 16.

By virtue of the provision of the detector arrangement 12 and the ejector or pusher element 13 at the displaceable support or carriage 20, there is achieved the beneficial result that the detection of a marking or separating element 7 and the ejection of the latter can be appropriately carried out during a pause or interval in the feed motion of the stack or stacking S. Compared with prior art constructions disclosed, for example, in the aforementioned Swiss Patent No. 657,338, in which the light barrier and the ejector blade are stationary and the detection of a marking foil in the stack of labels is accomplished while the latter travels past the fixedly arranged light barrier and ejector blade, the construction according to the invention renders possible a gain in time in that higher feed speeds are tolerable. In addition to this, a more reliable detection of the marking elements 7 is possible, because the hereto required relative velocity between the stack S and the detector arrangement 12 is independent of the feed speed of the stack or stacking S and can be therefore determined detachedly from the feed speed.

The displacement of the operating region or range of the detector arrangement 12 and of the ejector or pusher element 13 described in conjunction with FIGS. 2 through 5, obviously contributes to operational dependabilty in that the certainty with which the marking elements 7 are identified is substantially improved. However, it is also conceivable in certain applications to do without this displacement of the operating region or range.

As already previously mentioned, the detector arrangement 12 is responsive to brightness contrasts between the labels and the marking elements 7. The stronger the brightness contrast, the better the detection or identification of the marking or separating elements 7. The detector arrangement 12, i.e. the here not particularly illustrated control thereof, is structured such that the sensitivity of the detector arrangement 12 is automatically adapted to the brightness differences between the labels and the marking or separating elements 7. This is clearly illustrated by the diagram according to FIG. 7, in which the time t subsequent to commencing the search or hunting motion of the support or carriage 20 in the direction of the arrow B has been plotted along the abscissa, and the sensitivity R of the detector arrangement 12 has been plotted along the ordinate.

Figure 7:
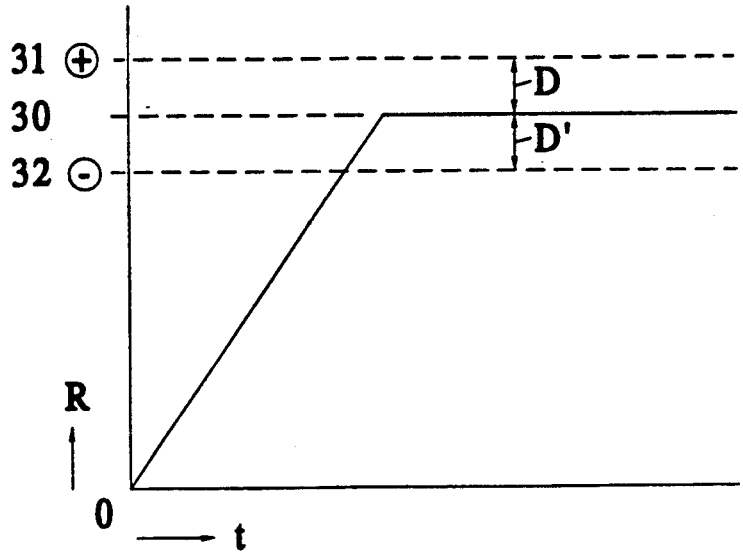
FIG. 7 shows a diagram exemplifying automatic adaptation of the sensitivity of a photodetector arrangement.

During the aforementioned search or hunting motion along the underside of the stack or stacking S, the detector arrangement 12 detects, on the one hand, the brightness of the labels and, on the other hand, the brightness of the marking or separating elements 7. In FIG. 7, a line 30 represents the brightness of the labels, while lines 31 and 32 depict the brightness of the marking or separating elements 7. The upper line 31 refers to marking elements 7 that are brighter than the labels, while the lower line 32 indicates the condition when the marking elements 7 are darker than the labels. The aforesaid automatic adjustment or setting of the sensitivity R of the detector arrangement 12 ensures at all times that respective sufficiently large brightness differences D and D' between the labels and the marking elements 7 are appropriately detectable for the detector arrangement 12.

Of course, it is possible to perform the inventive method in a different manner and structure the apparatus or installation 1 differently than the exemplary embodiment depicted in the drawings.

Thus, for instance, it is conceivable to use a detector arrangement 12 in which, similar to a light or photoelectric barrier, the light source and the photodetector are respectively arranged on the two opposite sides of the stack or stacking as disclosed, for example, in the aforementioned Swiss Patent No. 657,338. In this case, transparent or translucent marking or separating elements are preferably used.

The principle of detecting and ejecting marking or separating elements in a stack or stacking as described hereinabove in conjunction with FIGS. 2 through 6 can be readily applied in various fields of application other than label processing. The principle can be employed, for example, whenever there is a requirement for detecting or locating elements present in a regular or irregular order or pattern in a product stack or stacking. The detected and ejected elements can be then as such removed from the stack or stacking or, as previously described, can serve to trigger separating or parting operations, whereby such operations can be then accomplished precisely at the locations determined by the ejected marking or separating elements.

The adaptation or adjustment of the sensitivity of the detector arrangement 12, previously described in conjunction with FIG. 7, can be also employed in embodiments in which the detector arrangement is stationarily arranged and the detection of the marking or separating elements is accomplished in the course of feed motion of the stack past the detector arrangement, as disclosed, for instance, in the aforementioned Swiss Patent No. 657,338.

While there are shown and described present preferred embodiments of the invention, it is to be distinctly understood that the invention is not limited thereto, but may be otherwise variously embodied and practiced within the scope of the following claims. Accordingly,

What I claim is:

1. A method of detecting the position of a marking or separating element in a stack of substantially flat product by employing a detector arrangement comprising the steps of:

moving the detector arrangement along the stack from an original starting position; and detecting the presence of a marking or separating element in the stack during said step of moving the detector arrangement.

2. The method as defined in claim 1, further including the step of:

moving the detector arrangement into another starting position when the distance covered by the detector arrangement from the original starting position up to the detection of the presence of a marking or separating element is shorter than a predetermined distance.

3. The method as defined in claim 1, further including the step of:

automatically adapting the sensitivity of the detector arrangement in order to produce a sufficiently large difference between the brightness of the substantially flat products and the brightness of the marking or separating elements.

4. The method as defined in claim 3, wherein:

said step of automatically adapting the sensitivity of the detector arrangement entails the steps of detecting the brightness of the substantially flat products during said step of moving the detector arrangement along the stack and adapting the sensitivity of the detector arrangement in accordance with the detected brightness of the substantially flat products.

5. The method as defined in claim 1, further including the step of:

displacing by means of an ejector element the marking or separating element detected by the detector arrangement in a direction substantially transverse to the lengthwise direction of the stack, so that the marking or separating element projects over the stack.

6. The method as defined in claim 1, further including the steps of:

displacing the marking or separating element, detected by the detector arrangement, by means of an ejector element in a direction substantially transverse to the lengthwise direction of the stack such that the marking or separating element projects over the stack; and said step of moving the detector arrangement along the stack including co-moving the ejector element with the detector arrangement.

7. The method as defined in claim 1, further including the step of:

using the detection of the marking or separating elements for the purpose of detaching individual product packages determined by respective marking or separating elements from the remaining part of the stack.

8. A method of detecting the position of a marking or separating element in a stack of substantially flat products comprising the steps of:

moving a detector arrangement relative to the stack and along the latter;

detecting, during such relative motion, the presence of a marking or separating element in the stack; and automatically adapting the sensitivity of the detector arrangement for the purpose of producing a sufficiently large difference between the brightness of the substantially flat products and the brightness of the marking or separating elements.

9. The method as defined in claim 8, wherein:

said step of moving a detector arrangement entails moving a photodetector arrangement; and said step of automatically adapting the sensitivity of the detector arrangement entails the step of detecting the brightness of the substantially flat products during said step of moving the photodetector arrangement, and the step of adapting the sensitivity of the photodetector arrangement on the basis of the detected brightness of the substantially flat products.

10. The method as defined in claim 8, wherein:

moving the detector arrangement relative to the stack includes feeding the stack past the detector arrangement which is stationarily arranged.

11. An apparatus for detecting the position of a marking or separating element in a stack of substantially flat products comprising:

a detector arrangement;

means for moving said detector arrangement from a starting position and along the stack of substantially flat products; and said detector arrangement detecting during travel motion thereof along the stack the presence of a marking or separating element in the stack.

12. The apparatus as defined in claim 11, wherein:

said moving means comprise a traction element drivable in directions opposite to each other; and said detector arrangement being mounted at said traction element.

13. The apparatus as defined in claim 12, further including:

an ejector element co-moving with said detector arrangement;

the stack of substantially flat products having a lengthwise direction; and said ejector element serving to shift the marking or separating elements detected by said detector arrangement in a direction substantially transverse to said lengthwise direction of the stack.

14. The apparatus as defined in claim 13, wherein:

said ejector element is mounted at said traction element.

15. The apparatus as defined in claim 13, further including:

a parting arrangement for parting a stack portion determined by an ejected marking or separating element which protrudes above the stack; and said parting arrangement being activatable by said protruding marking or separating element.

16. The apparatus as defined in claim 11, further including: means for stepwise advance of the stack.

17. The apparatus as defined in claim 11, further including:

means for automatically adapting the sensitivity of said detector arrangement.

18. The apparatus as defined in claim 17, wherein:

said means for automatically adapting detector sensitivity are structured to adapt the sensitivity of said detector arrangement in accordance with the detection of the brightness of the substantially flat products during the travel motion of said detector arrangement along the stack.

* * * * *